US005814754A

United States Patent [19]

Mangolds

[11] Patent Number: 5,814,754

[45] Date of Patent: Sep. 29, 1998

[54] FALSE TARGET DEPLOYMENT SYSTEM

[75] Inventor: Arnis Mangolds, Stow, Mass.

[73] Assignee: Foster-Miller, Inc., Waltham, Mass.

[21] Appl. No.: 781,010

[22] Filed: Jan. 9, 1997

[51] Int. Cl.[6] ..... B64D 1/04; H01Q 15/00

[52] U.S. Cl. ..... 89/1.11; 342/10

[58] Field of Search ..... 342/8–10; 89/1.11; 102/348–352

[56] References Cited

U.S. PATENT DOCUMENTS

| | | | |
|---|---|---|---|
| 3,229,291 | 1/1966 | Dell'Aria et al. | 342/10 |
| 3,626,854 | 12/1971 | Brooks | 102/348 X |
| 3,938,151 | 2/1976 | Trenam | 342/10 |
| 4,166,597 | 9/1979 | Seifert et al. | 244/160 |
| 4,419,669 | 12/1983 | Slager et al. | 343/18 D |
| 5,061,929 | 10/1991 | Bell | 342/10 |
| 5,092,244 | 3/1992 | Giglia | 89/1.11 X |
| 5,238,406 | 8/1993 | Littell, III | 434/21 |
| 5,249,527 | 10/1993 | Schwind | 89/1.11 X |
| 5,345,238 | 9/1994 | Eldridge et al. | 342/10 X |
| 5,398,032 | 3/1995 | Tucker et al. | 342/9 |
| 5,424,741 | 6/1995 | Genovese | 342/10 |
| 5,493,993 | 2/1996 | Carter et al. | 114/312 |

FOREIGN PATENT DOCUMENTS 2121148 12/1983 United Kingdom .

*Primary Examiner*—Charles Jordan
*Assistant Examiner*—Matthew J. Lattig
*Attorney, Agent, or Firm*—Iandiorio & Teska

[57] ABSTRACT

A false target deployment system including an inflatable and collapsible decoy packaged in a munition for deploying the decoy in its collapsed state from an actual target at risk due to a potential threat. The decoy is rapidly inflated during deployment and the decoy includes coatings and/or other devices for emulating the infrared, radar and/or laser reflectivity characteristics of the actual target thereby providing a false target for the threat.

44 Claims, 9 Drawing Sheets

FALSE TARGET DEPLOYMENT SYSTEM

FIELD OF INVENTION

This invention relates to a false target deployment system which deploys, from a standard munition, an inflatable decoy which mimics an actual target thereby deceiving any incoming threat to the actual target by confusion and seduction.

BACKGROUND OF INVENTION

Tanks and other land vehicles, ships, and aircraft can be damaged or destroyed by an enemy's airborne missiles which detect and track their targets using radar, passive microwave, infrared, and/or laser based detectors. Often, the armored vehicle or ship commander has less than several seconds to take evasive action from the time the incoming threat is detected and even then modern missiles can track and follow the target, especially slow moving targets such as ships and tanks.

Attempts to destroy the incoming missiles are often times futile although the "Phalanx" shot-down mechanism used on board ships has proven somewhat successful. Even with the phalanx, however, the warhead of the incoming missile, because of its momentum, can still reach the ship causing severe damage.

So, there has been some work in the area of decoys which emulate an actual target. The goal is to fool an incoming threat by providing a false target which increases the odds of survival by at least 50% The decoy disclosed in U.S. Pat. No. 4,419,669 is a missile or satellite decoy whose radar signature is tuned to match the radar signature of an actual missile or satellite. The decoy shown in U.S. Pat. No. 5,398,032 is an aircraft towed decoy whose radar signature is tuned to exceed the radar signature of the real aircraft.

These decoys, however, cannot be quickly deployed from a ship or land vehicle such as a tank or other armored vehicle and they lack any means to emulate the actual target's infrared signature or to reflect laser energy in the same manner as the potential real target.

And, since modern weapons typically include means for cross checking the detection of an actual target, these prior art decoys will not always fool sophisticated weaponry. For example, an antitank munition may first check the ratio of infrared emittance of a potential target between 3–5 microns and then again between 8–12 microns to eliminate false readings from flares, rocks, or other land masses.

The decoy shown in U.S. Pat. No. 4,166,597 does include a heater blanket used to emulate the infrared signature, apparently of a re-entry vehicle, but its structure is not suitable for emulating ships or land vehicles such as tanks.

Also, all these prior art decoys suffer from the limitation that they do not look like an actual target. In tank warfare especially, if a decoy does not actually have the profile and surface distribution similar to a tank, adept land or air based reconnaissance personnel or weaponry will not be fooled.

Most importantly, however, the prior art fails to disclose a rapidly deployable false target decoy which begins to emulate the actual target within seconds of detecting an incoming threat.

SUMMARY OF INVENTION

It is therefore an object of this invention to provide a false target deployment system.

It is a further object of this invention to provide such a false target deployment system capable of rapidly deploying an inflatable decoy which closely emulates an actual target such as a vehicle or ship in form and signature distribution.

It is a further object of this invention to provide such a false target deployment system which is capable of deploying an inflatable decoy from a standard munition.

It is a further object of this invention to provide such a false target deployment system which includes means for emulating both the active and passive radar signature and the infrared signature of a real target such as a vehicle or ship in all appropriate bands.

It is a further object of this invention to provide such a false target deployment system which deploys an inflatable decoy which actually looks the same as the real target.

It is a further object of this invention to provide such a false target deployment system which reflects laser energy in the same manner that the actual target reflects laser energy.

It is a further object of this invention to provide such a false target deployment system which deploys a stand alone self-supporting inflatable decoy eliminating the need to tow or otherwise support the decoy.

It is a further object of this invention to provide such a false target deployment system which deploys a stand-alone inflatable decoy which remains inflated long enough for the actual target to maneuver out of danger.

It is a further object of this invention to provide such a false target deployment system which fools even sophisticated weaponry employing means for cross-checking target detection.

It is a further object of this invention to provide a three-dimensional structure similar to a vehicle such as a tank or a ship so that it emulates such a vehicle independent of the azimuth or bearing of the attacking munition.

It is a further object of this invention to provide such a false target deployment system which deploys an inflatable decoy within seconds from the time an incoming threat is detected.

This invention results from the realization that a ship or land vehicle such as a tank can be saved from destruction by incoming threat such as a missile by packaging an inflatable decoy within a standard ship or tank munition and then deploying the inflatable decoy so that it inflates near the actual target into a configuration which looks like the actual target and that the incoming threat can be fooled, confused, and seduced into targeting the decoy instead of the actual target by designing the decoy to have an infrared signature, active and passive radar signature, and even a laser reflectivity profile which closely emulates the infrared signature, active and passive radar signature, and laser reflectivity profile of the actual target.

This invention features a false target deployment system comprising: an inflatable and collapsible decoy; a munition for deploying the decoy from its collapsed state from an actual target at risk due to a potential threat; means for inflating the decoy during deployment; and means, integral with the decoy, for emulating the characteristics of the actual target thereby providing a false target for the threat.

The decoy typically is formed from a sheet material forming a hollow shell when inflated. The means for inflating includes at least one heater connected to the perimeter of the shell for providing air into the shell.

The means for inflating includes typically a plurality of weights connected to the perimeter of the shell. The munition includes a casing enclosing an ejection charge disposed within its proximal end, the collapsed decoy disposed within the casing body, and a pusher element disposed between the ejection charge and the decoy for deploying the decoy. The weights are packaged in a circumferential fashion around the interior of the distal end of the casing. Also included is a perimeter weight deployment charge disposed between the weights for deploying them after launch.

Further included is a trigger mechanism for triggering the deployment charge in response to the ignition of the ejection charge after a short delay from the ignition of the ejection charge. The munition further includes the primary heater disposed within the distal end of munition casing and means for igniting the primary heater in response to the ignition of the ejection charge.

The means for emulating may include: a pyrophoric coating on the surface of the decoy which ignites in the presence of air to heat the surface of the decoy causing it to emit an infrared signature; a medium borne by the decoy for producing an infrared signature which approximates the infrared signature of the actual target; and/or a medium borne by the decoy for producing passive millimeter wave and active reflecting radar signals in approximately the same manner that the actual target reflects radar signals. If the actual target structure is a vehicle such as a tank having a engine body portion and a track portion, the decoy includes an engine body portion and a track portion each having a coating emitting the correct signature painted thereon. A pattern of dipole crosses may be formed on the decoy to approximate the passive millimeter signature of the actual target. If actual target is a tank including a turret portion; the decoy also has a turret portion and the pattern of infrared dipole crosses and coatings are formed on the top surface of the turret.

The dipole crosses are preferably random in orientation. The decoy may also include a plurality of active radar reflectors positioned thereon. If the actual target is a tank having a body portion and a turret portion on the body portion; the decoy also includes a body portion and a turret portion and the radar reflectors are spaced around the perimeter of the turret portion. The radar reflectors may be triangular sheets of radar reflective material such as aluminum foil positioned with one leg of each sheet attached to the turret portion and the other leg of each sheet attached to the body portion, the hypotenuse of each triangular sheet extending between the turret portion and the body portion of the decoy.

The means for emulating may also includes a medium borne by decoy for reflecting laser energy directed at the decoy in approximately the same manner as the actual target reflects laser energy. If actual target is a tank having a turret portion with vertically extending walls the decoy structure also includes a turret portion with vertically extending walls which have a coating such as titanium dioxide paint.

This invention also features a false target deployment system comprising: a munition including a collapsed decoy packaged therein; means for ejecting the munition from an actual target, means for deploying the decoy out of the munition; and means, integral with the decoy, for emulating the characteristics of the actual target. The means for ejecting the munition includes an ejection charge disposed within the munition and the means for deploying the decoy includes a pusher plate responsive to the ejection charge.

The decoy includes a shell shaped body portion defining an open bottom perimeter portion and wall surfaces extending upwards from the open bottom perimeter portion. The decoy typically includes a set of perimeter weights disposed around the bottom perimeter portion and the munition further includes perimeter weight deployment means for spreading the perimeter weights after the decoy is deployed out of the munition. The perimeter weights are preferably packaged circumferentially within the munition and the means for spreading includes a charge disposed between the perimeter weights. Also included is a triggering device for igniting the charge in response to the means for deploying the decoy out of the munition. The decoy further includes at least one heater connected to the shell shaped body for forcing hot gas into the interior of the shell shaped body portion. Another trigger device operates the heater in response to the means for deploying the decoy out of the munition.

The means for emulating includes: means for matching the infrared signature of the decoy with the infrared signature of an actual target such as one or more emissive coatings on the decoy including a pyrophoric compound, and/or a non-pyrophoric compound which emits infrared radiation when heated; means for tuning the passive and active radar signature of the decoy to match the radar signature of an actual target such as a pattern of random length dipole crosses disposed on the decoy; a plurality of radar reflective elements disposed on the decoy; and/or means for reflecting laser energy from the surface of the decoy such as one or more coatings of a reflective compound on the decoy.

The invention further includes a plurality of such decoys deployable from an aircraft such as a helicopter, or a ship.

DISCLOSURE OF PREFERRED EMBODIMENT

Other objects, features and advantages will occur to those skilled in the art from the following description of a preferred embodiment and the accompanying drawings, in which.

Figure 11:
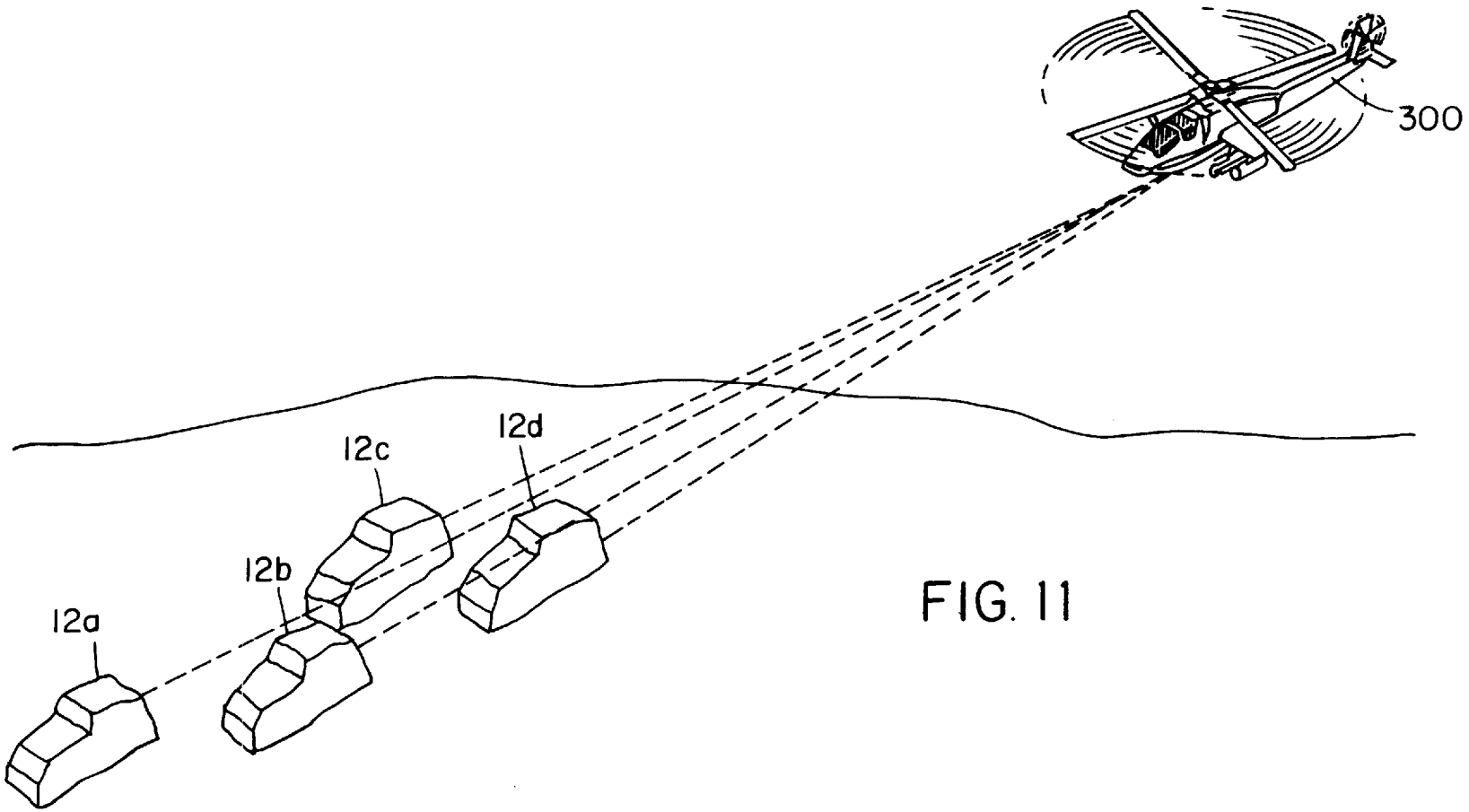
Figure 12:
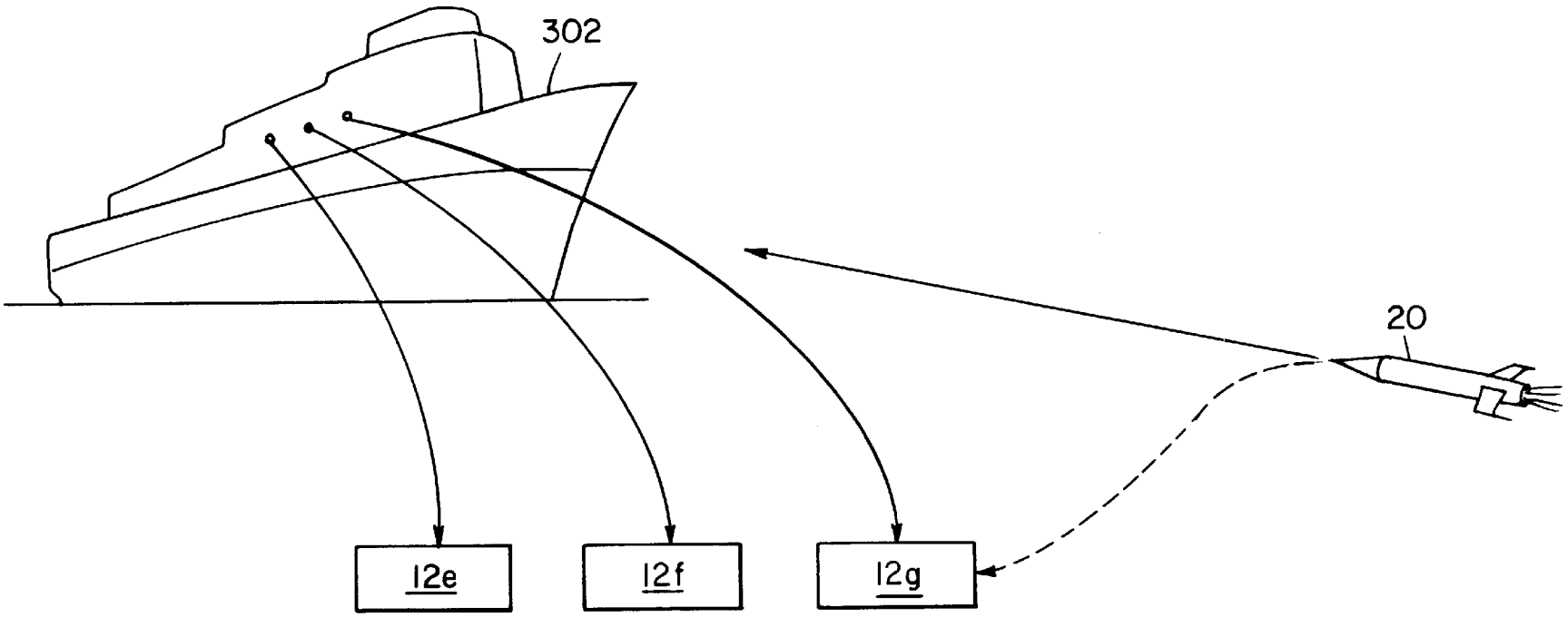

FIG. 11 is a schematic three dimensional view of another embodiment of a false target deployment system in accordance with this invention in which multiple inflatable and collapsible decoys are deployed from an aircraft such as a helicopter; and FIG. 12 is a schematic view of another embodiment of the false target deployment system of this invention in which a number of inflatable decoys are deployed from a vessel such as a military ship.

Figure 1:
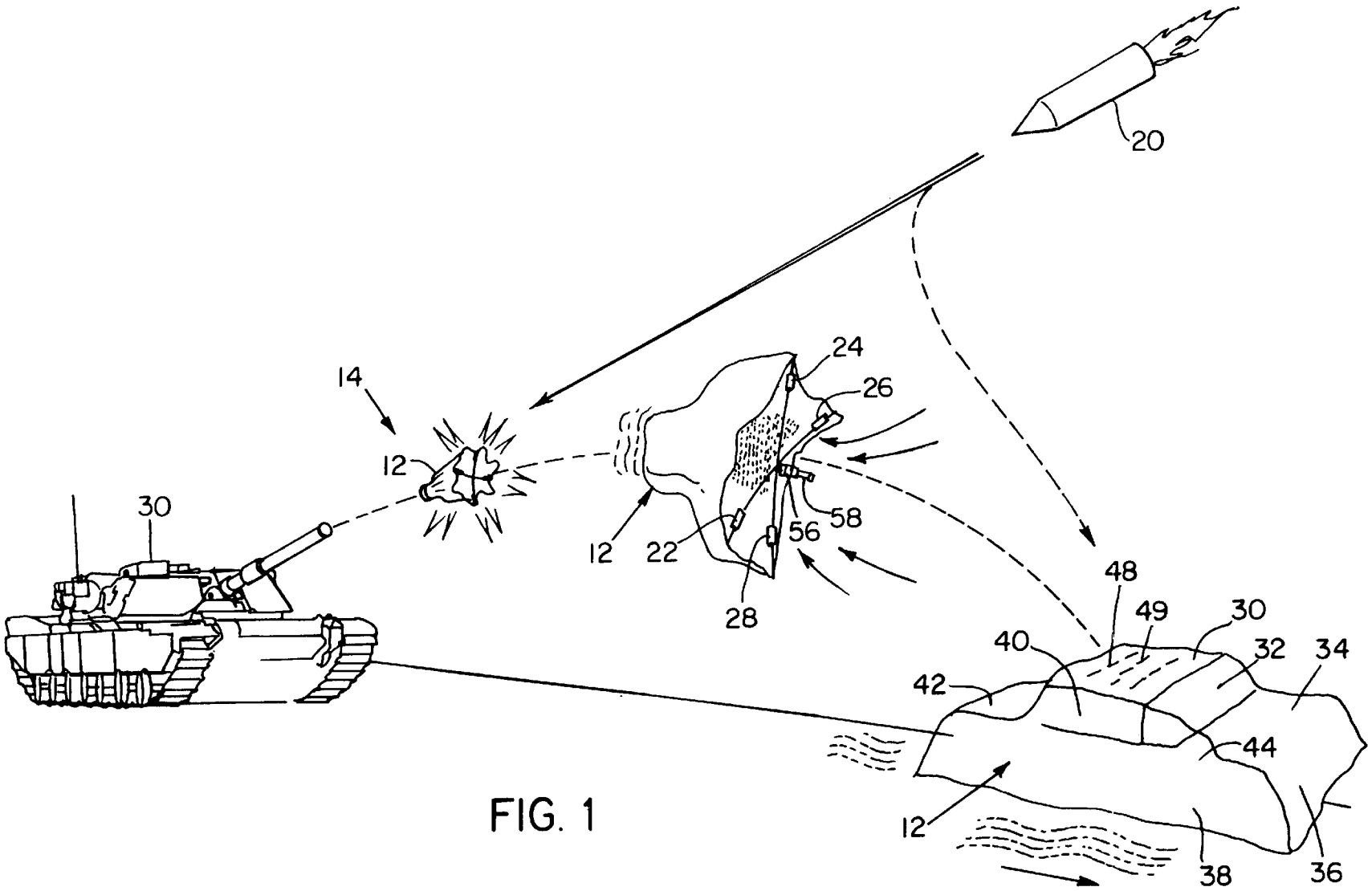
FIG. 1 is a three dimensional schematic view depicting the operation of the false target deployment system of this invention.

This invention features a false target deployment system which is useful in the following scenario. An armored vehicle 30, FIG. 1 is advancing in enemy territory when suddenly the tank's threat warning indicators begin to sound. The overcast night sky may reduce the tank commander's vision and he may have no idea where the threat is coming from or whether it is even tended for his vehicle. The threat could be ground to ground, a patrol, or a top attack sensor-fused mortar. If the tank commander operates signal jammers or deploys flares, he exposes his position. The tank commander is typically not sure whether the threat is laser guided, microwave guided, and/or infrared guided.

In accordance with this invention, however, the tank commander deploys smoke grenades and also initiates the operation of the false target deployment system of this invention. Inflatable decoy 12 of the false target deployment system of this invention, once deployed, instantly bursts open as shown at 14, and a 25 microinch coating of white phosphorus on decoy 12 begins to ignite on contact with the air instantly producing an infrared signature. This thin phosphorus coating produces a signature which is not overpowering and which does not cause threat 20 to reject the infrared signal. Lasting 0.2 seconds, the thin phosphorus coating also begins to warm the underlying substrate of decoy 12.

Simultaneously with the ejection of decoy 12 from tank 30, a small charge is ignited deploying perimeter weights 22, 24, 26 and 28 which assist in inflating decoy 12 after it is deployed to form the same three dimensional shape and area as the actual target, tank 30. A pyrotechnic heater (not shown) ignites and burns supplying ram-inflation heated air at a temperature of 200° C. within the interior of decoy 12. The heat supplied by a pyrophoric coating such as the thin coating of phosphorous discussed above, and the primary heater, warms the skin temperate of decoy 12° to 80° C. in less than 0.3 seconds.

The skin of decoy 12 is also doped or coated with special coatings such as mixture of anatase and cobalt blue glass in certain areas such as areas 38 and 42 so that it begins to emit the same infrared signature as tank 30 in both the 3–5 and 8–12 micron range. Dipole prints on the decoy in turret area 30 produces emissivity and reflectivity signatures in the passive millimeter wave bands waves and such as 35 and 95 GHz range of the microwave regime thereby emulating the radar signature of tank 30. Hot spots 38 and 40 where the road wheels or tracks and the engine exhaust should be appear to incoming threat 20 to have all the distinguishing characteristics of tank 30 and a titanium dioxide coating in areas 36, 40, and 44 reflects laser designator wave lengths in the appropriate manner.

As threat 20 nears actual target 30, target 30 maneuvers into the smoke generated by the smoke grenades and threat 20, seeking some combination of correct spectra radiance in the infrared and/or microwave wave bands, proceeds towards decoy 12 as shown instead of along a path which would destroy tank 30.

The shell of decoy 12 is fabricated from a polymer material such as ABS plastic, polystyrene, polypropylene, or similar materials such as those sold under the trademark "KAPTON". Decoy 12, because of its physical configuration, emulates the actual features of tank 30.

Heaters 56 and 58 attached to decoy 12 raise and maintain its skin temperature and also serve to maintain inflation of the decoy 12. Self regulating vents 48, 49 etc. permit selective heating, control the buoyancy of decoy 12, and in some cases may be used for propulsion.

Figure 2:
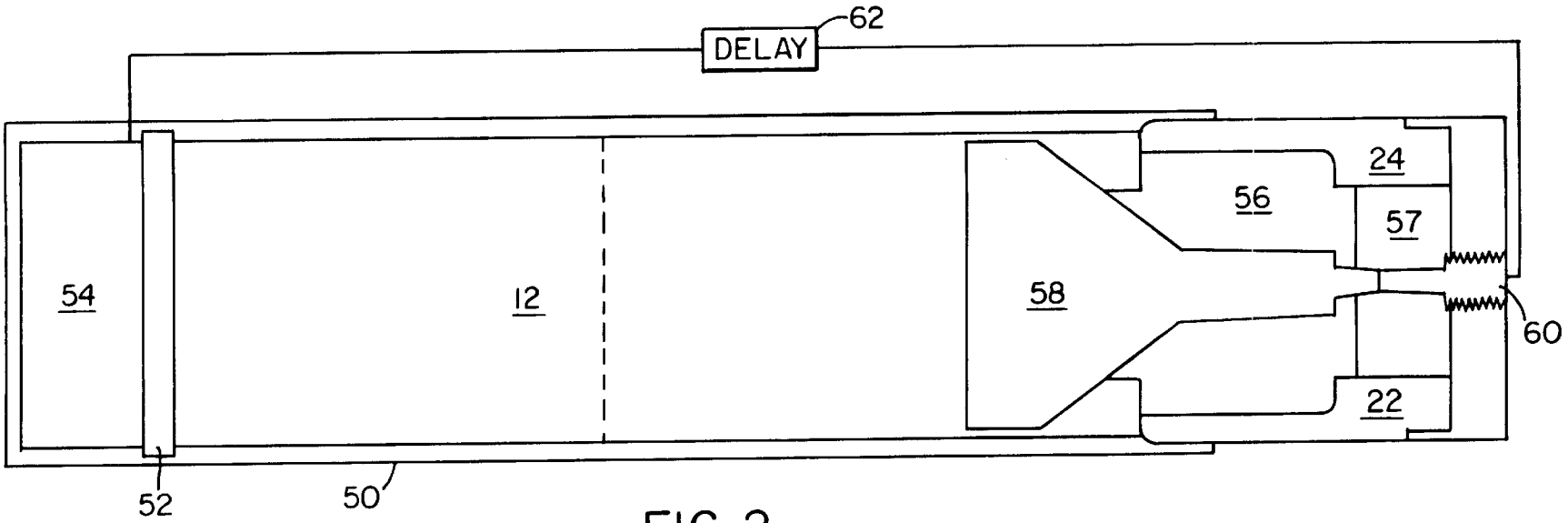
FIG. 2 is a schematic cut away side view of the munition casing used for deploying the decoy of the false target deployment system of this invention.

Decoy 12, in its collapsed state, FIG. 2 is packaged within a 66 or a 76 mm munition casing 50 in front of pusher plate 52 which ejects decoy 12 after ejection charge 54 is triggered by the turret gun of tank 30, FIG. 1. Also housed within munition casing 50, FIG. 2, is primary heater 56 and an optional secondary heater 58 in the form of the pyrotechnic heaters discussed above.

Perimeter weights 22, 24, 26 and 28, FIG. 1 are also packaged within casing 50, FIG. 2 as shown. Explosive charge 57 is triggered by initiator 60 to deploy the perimeter weights 22, 24 etc. after a short millisecond delay provided by delay circuitry 62 from the time munition 50 leaves the end of the turret gun of tank 30, FIG. 1. The perimeter weights, attached to the bottom perimeter of decoy 12 then fly apart from each other inflating decoy 12 shortly after it and its heaters 56 and 58 are ejected from casing 50. Heaters 56 and 58 are attached to the bottom of inflatable structure 12 via flat and flexible ribbons of "Kevlar" to both maintain the inflation of decoy 12 and to heat its skin to the appropriate temperature as discussed above.

Monitor casing 50 has a diameter of approximately 66 mm and a length of approximately 273 mm. Ejection charge 54 extends approximately 25 mm in the rearward portion of casing 50 as shown. Decoy 12 is folded into a length of approximately 180 mm and has a diameter of approximately 60 mm. Heaters 56 and 58 occupy approximately 66 mm of the forward portion of casing 50 as shown. Perimeter weights 22, 24, 26 and 28 are approximately 60 mm long and 2 cm thick. Explosive charge 57 is approximately 20 mm long.

Figure 3:
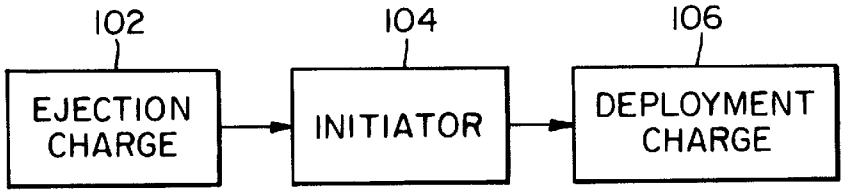
FIG. 3 is a schematic block diagram of the electronic circuitry housed within the munition casing shown in FIG. 2 for deploying and inflating the inflatable decoy of the target deployment system of this invention.

The ejection of inflatable and collapsible decoy 12, FIG. 2, and its attached heaters 56 and 58 and the deployment of the perimeter weights 22 and 24 is accomplished in accordance with the flow chart shown in FIG. 3.

The ejection charge 54, FIG. 2, is ignited, step 102, FIG. 3, thus triggering delay circuit 62, FIG. 2. After a short millisecond delay, delay circuit 62 triggers initiator 60, step 102, FIG. 3, which in turn ignites explosive charge 57, FIG. 2, step 106, FIG. 3. Explosive charge 57, FIG. 2, deploys perimeter weights 22 and 24 and ignites heaters 56 and 58 (optional).

Figure 4:
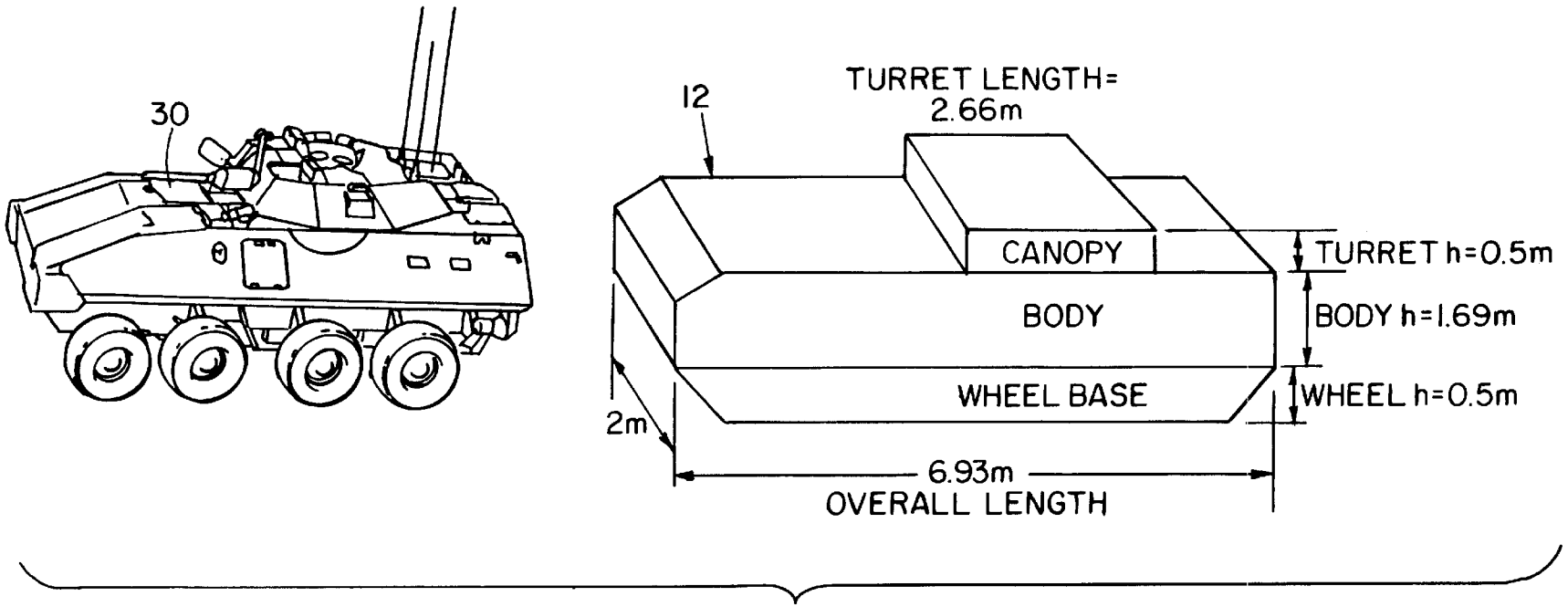
FIG. 4 is a schematic three dimensional view of the structure of one embodiment of the inflatable decoy of the false target deployment system of this invention.

Decoy 12, FIG. 4 is designed to have the same physical dimensions as the actual vehicle from which it is deployed such as a LAV-25 (light attack vehicle) or other tank such as the AAVC7A1, M1A1 MBT, M2 BRADLY, and M113A1 APC. For an LAV vehicle, the overall length is 6.93 meters and the overall width is 2 meters. The wheel height is approximately 0.5 meters and the body height is approximately 1.69 meters. The turret height is approximately 0.5 meters and the turret length is approximately 2.66 meters, as shown. The structure sewn and taped together and the structural shape is maintained by internal guidelines.

Therefore, in contrast to the prior art, the false target deployment system of this rapidly deployable invention features an inflatable and collapsible decoy 12 which has approximately the same physical dimensions as an actual military vehicle. Also in contrast to the prior art, decoy 12 includes means for emulating the other characteristics of an actual target for providing a true false target to an incoming threat from all aspect angles.

Figure 5:
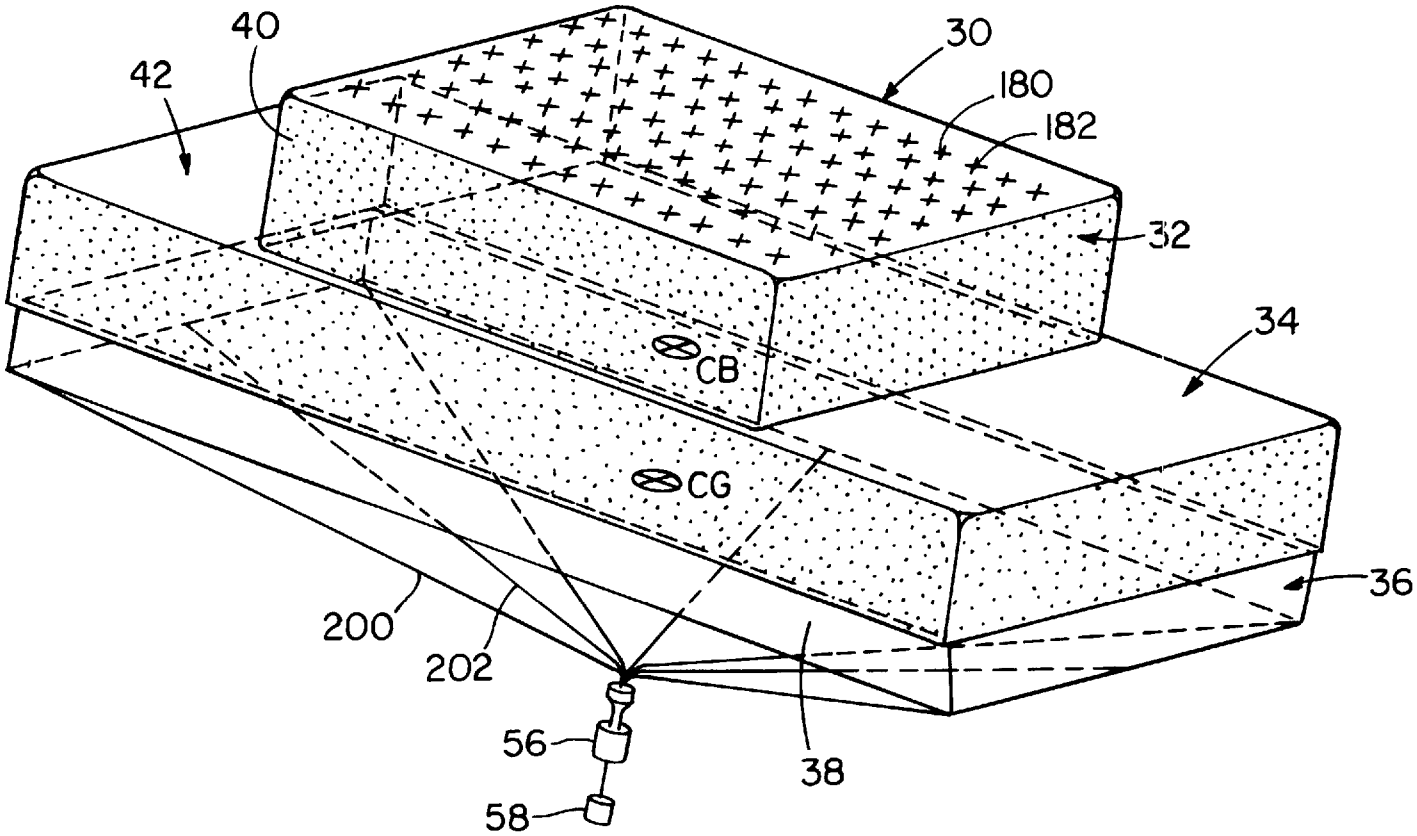
FIG. 5 is a schematic three dimensional view of an inflatable decoy for emulating the infrared, radar, and laser signatures of a tank in accordance with one embodiment of the false target deployment system of this invention.
Figure 6:
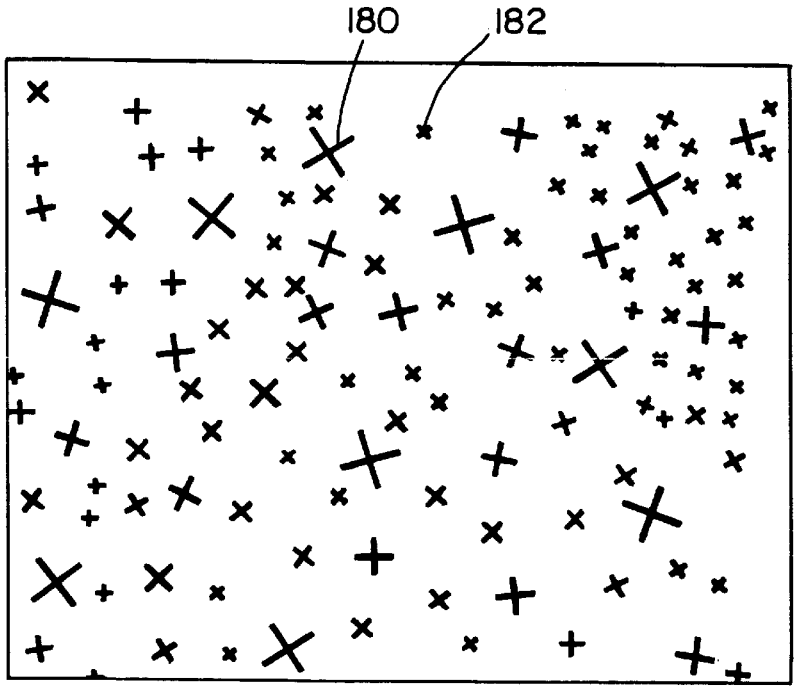
FIG. 6 is a schematic diagram depicting the dipole cross pattern on the decoy shown in FIG. 5.
Figure 7:
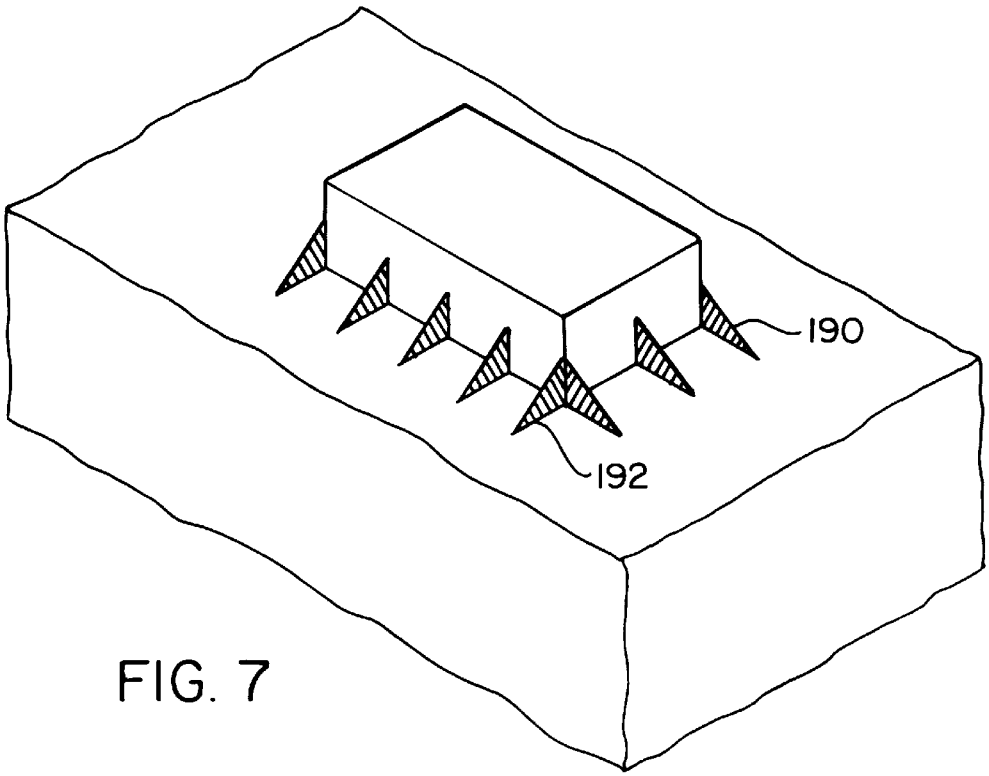
FIG. 7 is a schematic three dimensional view of the means for emulating an actual target's radar signature of the inflatable decoy of this invention.

To emulate the radar signature of an actual target, decoy 12, FIG. 5 must appear as if it were a 60 ton vehicle mass across several bandwidths. Therefore, turret area 30 includes a number of conducting dipole crosses 180, 182, etc. to control the emissivity, reflectance, and absorption of the skin of decoy 12. Dipole crosses 180, 182 are shown in more detail in FIG. 6. A printed array of randomly oriented, half wave length resonant dipoles (half wavelength long printed wires) of conductive powders such as ferrite and carbon are used as extremely low loss resonant structures and the spacing between the individual dipoles and the dipole dimensions are accurately controlled depending on the structure to be emulated. The spacing requirements and a number of elements needed at the mm-wave frequency make resonant dipole rays extremely expensive. Therefore, in this invention, random length dipole crosses are used which can be made by low cost printing processes to render the skin of decoy 12 absorptive and broadband. Corner radar reflectors 190, 192, FIG. 7, made of aluminum foils, are in the form of triangular sheets such that one leg of each sheet is attached to the turret portion of the structure and the other leg of each sheet is attached to the body portion as shown.

Figure 8:
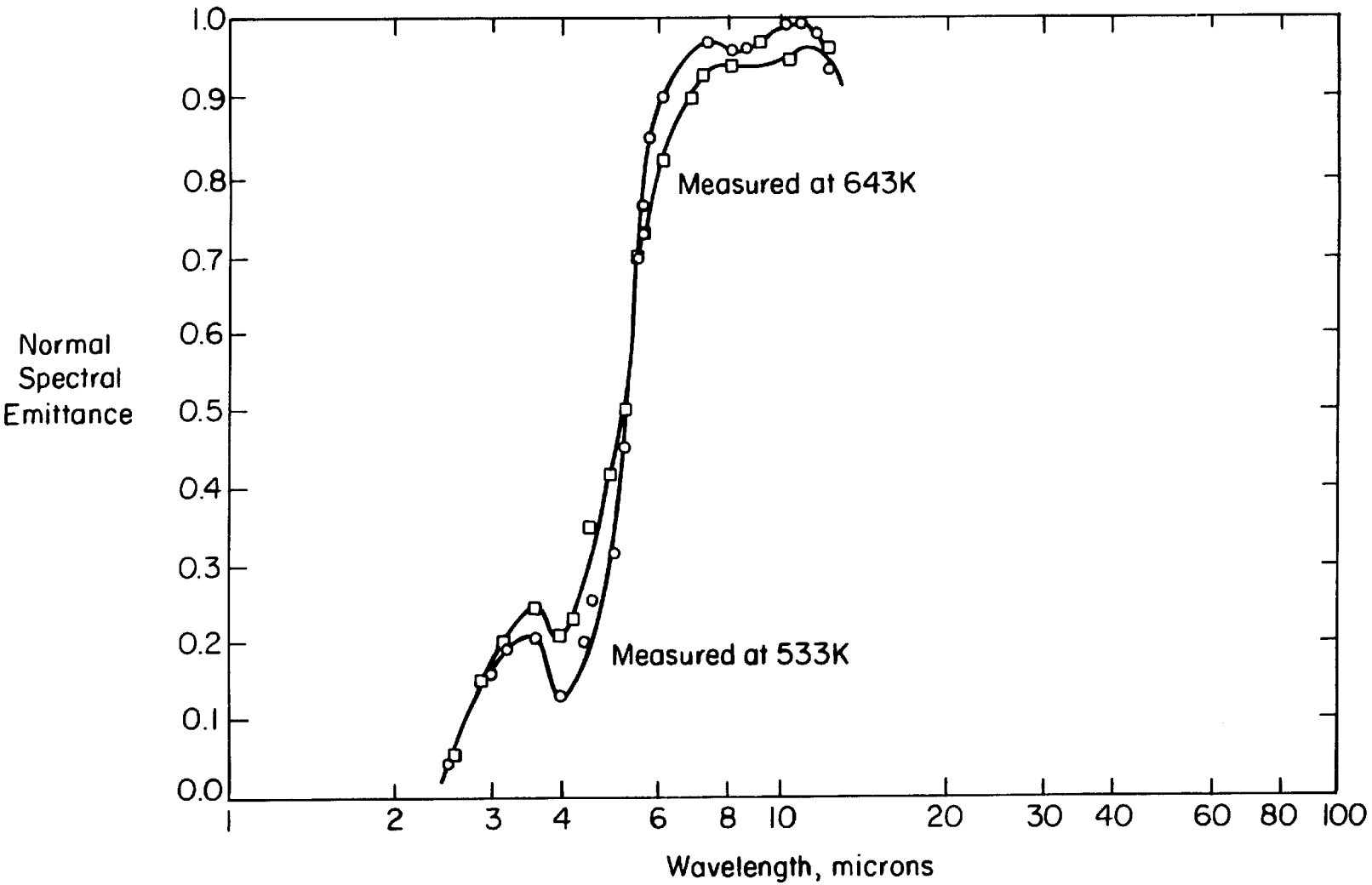
FIG. 8 is a chart showing the spectral emittance of a coating over a variety of wavelengths used in this invention to emulate the infrared signature of an actual target.

Another feature of decoy 12, FIG. 1 is the ability to emulate the proper infrared emissivity signature of an actual tank. There are a number of coatings for the appropriate emissivity which emulate cooler temperature bodies and address dual band detectors. Therefore, in area 34, FIG. 5 and other cool body areas of decoy 12, a coating of titanium dioxide or anatase can be applied while in hotter areas, such as engine area 42, and wheel or track area 36, cobalt blue glass can be used alone since, when heated, it emits the proper amount of spectral emittance in both the 3–5 and 8–12 micron wave-lengths as shown in FIG. 8 closely emulating the actual hot spots of a real vehicle. Other candidate materials for these hot spots includes beryllium niobate and magnesium difluoride.

To provide the proper reflection of laser energy from laser guided missiles and other weaponry, vertical face areas 32 and 40, for example, of decoy 12 may be coated with titanium dioxide paint which reflects laser energy in the same manner as it would be reflected from an actual vehicle.

As discussed above, different coatings and different combination of coatings will be used depending on the actual target to be emulated but the combination of the substrate of decoy 12 and any coatings thereon should closely emulate the infrared signature, the microwave signature, and the reflectivity of laser energy of an actual target. The substrate of decoy 12 generally has a thickness of less than 1 mill, a tensile strength of at least 20 psi, and a flame propagation characteristic (UL-910) providing a flame spread of less than 27.5 mm for 10 minutes. Suitable materials include various plastic such as "Kapton", "Capton" and other thin films. As shown in FIG. 5, primary heater 56 maintains the buoyancy, inflation, and temperature of decoy 12, and when its is expended, optional secondary heater 58 continues to inflate structure 12. The primary 56 and secondary 58 heat sources are typically suspended below the center of gravity of decoy 12 by flat ribbons of "Kevlar" or any other flame-proof thin material 200, 202, etc. For prolonged duration (approximately 2 hours) inflation and heating of decoy 12 used to mimic an actual LAV-25 vehicle which has a surface area of 60 meters squared, it was calculated that temperature of the skin of structure 12 should be 50° C. Assuming a heat transfer coefficient of 6 $w/m^{2}$°C. (glass surface in a 15 mph wind) for the convection losses on both sides of the skin and a night sky temperature of 200° K. (−73° C.) and skin emissivity of 0.2 for the radiation loses, the overall heat transfer coefficient is 0.66 $w/m^{2}$°C. The net heat rate is then 4,883 W or 16,700 BTU/hr. This heat rate falls within the capabilities of even the smallest kerosene-fired space heaters. As an example, a kerosene-fired radiant salamander can produce up to 140,000 BTU/hr but only consume about 1 gallon of fuel per hour. Therefore, for a two hour, 16,700 btu/hr requirement, the heat of one quart of kerosene will keep the system at proper temperature.

Figure 9:
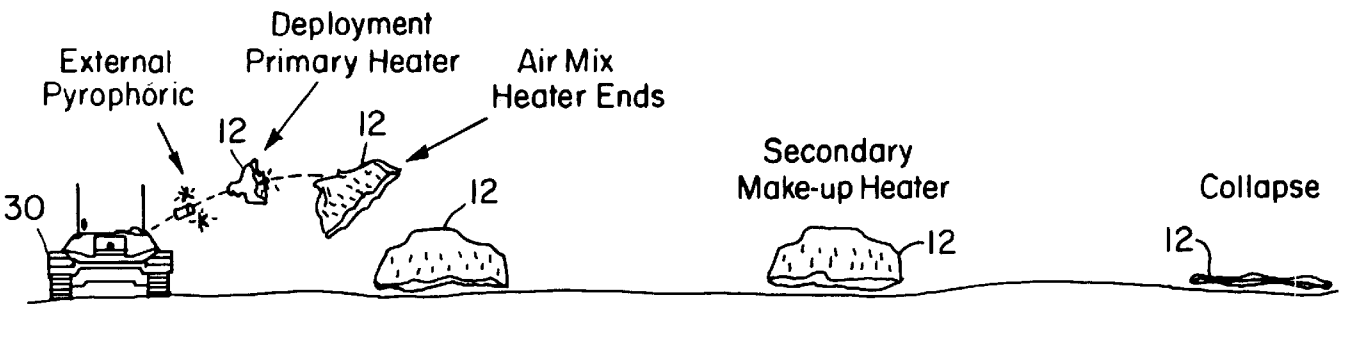
FIG. 9 is a schematic view depicting the chain of events which occur during the deployment of the decoy of this invention.
Figure 10:
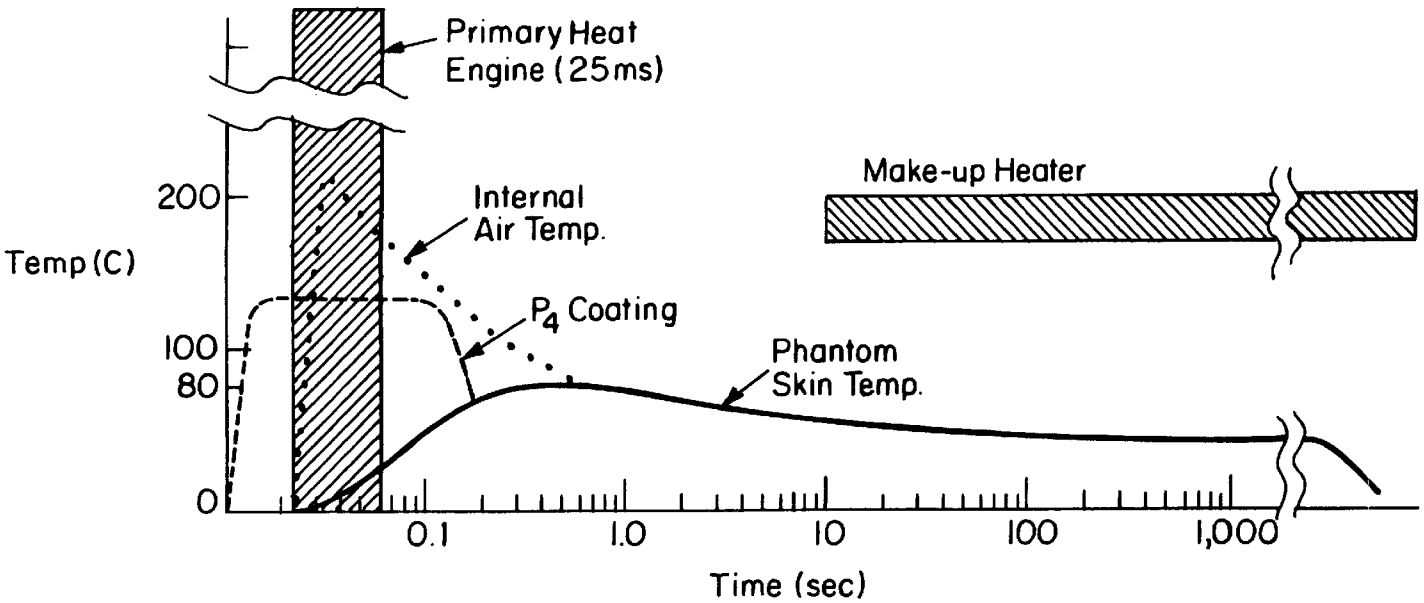
FIG. 10 is a timing diagram showing the amount of time which elapses between the deployment events shown in FIG. 9.

As discussed above, it is very important that the decoy 12, FIG. 9, inflate very quickly. As shown in FIG. 10, within a fraction of a second after the munition is fired from tank 30, ejection charge 54, FIG. 2, fully deploys decoy 12 and its associated heaters 56 and 58, and perimeter weights 22 and 24. The phosphorus coating, now in contact with the air raises the temperature of the skin of decoy 12 to over 100° C. One millisecond later, charge 58, FIG. 2 deploys perimeter weights 22 and 24 and decoy 12 begins to inflate. At the same time, primary heater 56, FIG. 2, is ignited raising the skin temperature of the inflating decoy to over 100° C. Within one second, decoy 12, now fully deployed, settles on the ground. If required, structure 12 remains inflated via secondary heater 58, FIG. 2, for many minutes and even longer as shown in FIG. 10. Primary heater 56 and secondary heater 58 may be a source of rocket fuel such as black powder.

In another embodiment, several such decoys 12*a*, 12*b*, 12*c* and 12*d* are deployed via the standard guns of aircraft 300, FIG. 11 to provide a number of false targets on the battlefield to protect the real tanks and land vehicles and also to fool the enemy into believing that the size of the friendly force is greater than it is. Also, as shown in FIG. 12, a number decoys 12*e* and 12*f*, and 12*g* may be deployed from ship 302, FIG. 12 to fool incoming threat 20 into thinking that decoys 12*e*, 12*f*, and 12*g* actually comprise a single large body.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A false target deployment system comprising:

an inflatable and collapsible decoy;

a munition for deploying said decoy in its collapsed state, from an actual target at risk due to a potential threat;

means for inflating the decoy after it is deployed; and means, integral with said decoy, for emulating the shape, infrared signature, and radar signature characteristics of the actual target thereby providing a false target for the threat.

2. The system of claim 1 in which said decoy includes a sheet material forming a shell when inflated.

3. The system of claim 2 in which said means for inflating includes at least one heater connected to shell material for providing air to the shell.

4. The system of claim 2 in which said means for inflating includes a plurality of weights connected to the perimeter of said shell.

5. The system of claim 4 in which said munition includes a casing including:

an ejection charge disposed within its proximal end, the collapsed decoy disposed within the casing body, a pusher element disposed between the ejection charge and the decoy for deploying the decoy; and said plurality of weights packaged in a circumferential fashion around the interior of the distal end of the casing.

6. The system of claim 5 in which the munition further includes a perimeter weight deployment charge disposed between the weights for deploying said weights.

7. The system of claim 6 further including trigger means for triggering said deployment charge in response to the ignition of the ejection charge.

8. The system of claim 7 in which said trigger means includes delay means for triggering said deployment charge after ignition of said ejection charge.

9. The system of claim 5 in which said munition further includes a primary heater disposed within the distal end of said munition casing and means for igniting said primary heater in response to the ignition of said ejection charge.

10. The system of claim 1 in which said means for emulating includes a pyrophoric coating on the surface of the decoy which ignites in the presence of air to heat the surface of the decoy causing it to emit an infrared signature.

11. The system of claim 1 in which said means for emulating includes a medium borne by the decoy for producing an infrared signature which approximates the infrared signature of the actual target.

12. The system of claim 11 in which the actual target structure is a vehicle having an engine body portion and a track portion and the decoy includes an engine body portion and a track portion each having a coating of emitting cobalt blue paint thereon.

13. The system of claim 1 in which said means for emulating includes a medium borne by the decoy for reflecting radar signals.

14. The system of claim 13 in which said decoy includes a pattern of dipole crosses thereon tuned to approximate the radar signature of the actual target.

15. The system of claim 14 in which the actual target is a vehicle including a turret portion; the decoy having a turret portion including a pattern of dipole crosses formed on the top surface thereof.

16. The system of claim 15 in which dipole crosses are of random orientation.

17. The system of claim 13 in which said decoy includes a plurality of radar reflectors positioned thereon.

18. The system of claim 17 in which said actual target is a vehicle having a body portion and a turret portion on said body portion; said decoy also including a body portion and a turret portion on said body portion, said radar reflectors spaced around the perimeter of said turret portion.

19. The system of claim 18 in which said radar reflectors are triangular sheets of aluminum foil positioned with one leg of each sheet attached to the turret portion and the other leg of each sheet attached to the body portion, the hypotenuse of each triangular sheet extending between the turret portion and the body portion of the decoy.

20. The system of claim 1 in which said means for emulating includes a medium borne by decoy for reflecting laser energy directed at the decoy.

21. The system of claim 20 in which the actual target is a vehicle having a turret portion with vertically extending walls; the decoy structure also including a turret portion with vertically extending walls, said walls having a coating of material which reflects laser energy.

22. The system of claim 21 in which said coating is titanium dioxide paint.

23. A false target deployment system comprising:

a munition including a collapsed decoy packaged therein;

means for ejecting said munition from an actual target, means for deploying said decoy out of said munition; and means, integral with the decoy, for emulating the shape, infrared signature, and radar signature characteristics of the actual target.

24. The system of claim 23 in which said means for ejecting said munition includes an ejection charge disposed within said munition.

25. The system of claim 24 in which said means for deploying said decoy includes a pusher plate responsive to said ejection charge.

26. The system of claim 23 in which said decoy includes a shell shaped body portion defining an open bottom perimeter portion and wall surfaces extending upwards from said open bottom perimeter portion.

27. The system of claim 26 in which said decoy further includes a set of perimeter weights disposed around said bottom perimeter portion.

28. The system of claim 27 in which said munition further includes perimeter weight deployment means for spreading said perimeter weights after said decoy is deployed out of said munition.

29. The system of claim 28 in which said perimeter weights are packaged circumferentially within said munition and said means for spreading includes a charge disposed between said perimeter weights.

30. The system of claim 29 further including a triggering device for igniting said charge in response to said means for deploying said decoy out of said munition.

31. The system of claim 26 in which said decoy further includes at least one heater connected to said shell shaped body for forcing hot gas into the interior of said shell shaped body portion.

32. The system of claim 31 further including a trigger device for operating said heater in response to said means for deploying said decoy out of said munition.

33. The system of claim 23 in which said means for emulating includes means for matching the infrared signature of the decoy with the infrared signature of an actual target.

34. The system of claim 33 in which said means for matching includes one or more emissive coatings on said decoy.

35. The system of claim 34 in which a said coating is a pyrophoric compound.

36. The system of claim 34 in which a said coating is a non-pyrophoric compound which emits infrared radiation when heated.

37. The system of claim 23 in which said means for emulating includes means for reflecting laser energy from the surface of said decoy.

38. The system of claim 37 in which said means for reflecting laser energy includes one or more coatings of a reflective compound on said decoy.

39. A multiple false target deployment system comprising:

a plurality of inflatable and collapsible decoys;

a plurality of munitions for deploying each said decoy in its collapsed state;

means for inflating each decoy after it is deployed; and means, integral with each decoy, for emulating the shape, infrared signature, and radar signature.

40. A false target deployment system comprising:

an inflatable and collapsible decoy including a sheet material forming a shell when inflated;

a munition for deploying said decoy in its collapsed state from an actual target at risk due to a potential threat;

an ejection charge disposed within the proximal end of the munition;

a pusher element disposed in the munition between the ejection charge and the decoy for deploying the decoy, and a plurality of weights packaged in a circumferential fashion around the interior of the munition;

means for inflating the decoy after it is deployed; and means, integral with said decoy, for emulating at least one characteristic of the actual target providing a false target for the threat.

41. A false target deployment system comprising:

an inflatable and collapsible decoy including a sheet material forming a shell when inflated;

a munition for deploying said decoy in a collapsed state from an actual target at risk due to a potential threat, the munition including a casing having an ejection charge disposed within its proximal end, the collapsed decoy disposed within the casing body;

a pusher element disposed between the ejection charge and the decoy for deploying the decoy;

means for inflating the decoy after it is deployed including a plurality of weights packaged in a circumferential fashion around the interior of the distal end of the casing;

a primary heater disposed within the distal end of said munition casing and means for igniting said primary heater in response to the ignition of said ejection charge; and means, integral with said decoy, for emulating at least one characteristic of the actual target thereby providing a false target for the threat.

42. A false target deployment comprising:

an inflatable and collapsible decoy;

a munition for deploying said decoy in its collapsed state from an actual target at risk due to a potential threat;

means for inflating the decoy after it is deployed; and means, integral with said decoy, for emulating the at least one characteristic of the actual target thereby providing a false target for the threat including a medium borne by the decoy for reflecting radar signals an a pattern of dipole crosses on the decoy turned to approximate the radar signature of the actual target.

43. A false target deployment system comprising:

an inflatable and collapsible decoy;

a munition for deploying said decoy in its collapsed state from an actual target at risk due to a potential threat;

means for inflating the decoy after it is deployed; and means, integral with said decoy, for emulating at least on characteristic of the actual target thereby providing a false target for the threat, said means for emulating including a medium borne by decoy for reflecting laser energy directed at the decoy, the actual target being a vehicle having a turret portion with vertically extending walls, the decoy structure also including a turret portion with vertically extending walls, said walls having a coating of material which reflects laser energy.

44. A false target deployment system comprising:

a munition including a collapsed decoy packaged therein, the decoy including a shell shaped body portion defining an open bottom perimeter portion and wall surfaces extending upwards from the open bottom perimeter portion;

means for ejecting said munition from an actual target;

means for deploying said decoy out of the munition; and means, integral with the decoy, for emulating at least one characteristic of the actual target.

* * * * *